US007622018B2

(12) United States Patent
Ottelin

(10) Patent No.: US 7,622,018 B2
(45) Date of Patent: Nov. 24, 2009

(54) ARRANGEMENT FOR AND A METHOD OF TREATING PULP, AND A METHOD OF MODERNIZING A PULP TOWER

(75) Inventor: Juha Ottelin, Tarvasjoki (FI)
(73) Assignee: Sulzer Pumpen AG, Winterthur (CH)

( * ) Notice: Subject to any disclaimer, the term of this patent is extended or adjusted under 35 U.S.C. 154(b) by 514 days.

(21) Appl. No.: 10/544,952

(22) PCT Filed: Jan. 19, 2004

(86) PCT No.: PCT/CH2004/000025

§ 371 (c)(1),
(2), (4) Date: Aug. 8, 2005

(87) PCT Pub. No.: WO2004/072363

PCT Pub. Date: Aug. 26, 2004

(65) Prior Publication Data

US 2006/0137839 A1 Jun. 29, 2006

(30) Foreign Application Priority Data

Feb. 12, 2003 (FI) ..... 20030209

(51) Int. Cl.

| | |
|---|---|
| ***D21C 7/08*** | (2006.01) |
| ***D21D 5/28*** | (2006.01) |
| ***B01F 7/00*** | (2006.01) |
| ***B01F 15/02*** | (2006.01) |

(52) U.S. Cl. ..... 162/57; 162/243; 366/168.1; 366/172.1

(58) Field of Classification Search ..... 366/341, 366/171.1, 172.2, 168.1, 172.1; 162/17, 162/246, 52, 57, 243
See application file for complete search history.

(56) References Cited

U.S. PATENT DOCUMENTS

| | | | | |
|---|---|---|---|---|
| 1,776,761 | A * | 9/1930 | Morterud | 162/41 |
| 3,787,284 | A * | 1/1974 | Richter | 162/246 |
| 5,397,434 | A | 3/1995 | Costa et al. | |
| 5,711,600 | A | 1/1998 | Youkonummi | |
| 2003/0111200 | A1 | 6/2003 | Prough et al. | |

* cited by examiner

*Primary Examiner*—Tony G Soohoo
(74) *Attorney, Agent, or Firm*—Townsend and Townsend and Crew LLP

(57) ABSTRACT

An arrangement for and a method of treating pulp, and a method of modernizing a pulp tower are disclosed. The arrangement and method relate to treating pulp in connection with high-consistency pulp towers, and especially to means (36, 42) for diluting pulp arranged substantially at the level of the smallest cross-sectional area between the parting member (31) and the wall (12) of the pulp tower (10).

16 Claims, 4 Drawing Sheets

ARRANGEMENT FOR AND A METHOD OF TREATING PULP, AND A METHOD OF MODERNIZING A PULP TOWER

BACKGROUND OF THE INVENTION

The present invention relates to an arrangement for and a method of treating pulp, and a method of modernizing a pulp tower. The arrangement and method relate to treating pulp in connection with high-consistency pulp towers, and especially to improvements in discharging pulp therefrom. The invention also relates to modernizations of pulp towers. High-consistency pulp towers are used in the wood processing industry, for instance, for bleaching and/or storage of high-consistency pulp.

According to prior art, pulp has to be discharged in a diluted form from high-consistency pulp towers. This is because high-consistency pulp cannot be pumped with, for example, a centrifugal pump, which, however, in recent arrangements is practically the only way of conveying pulp from one process stage to another. Therefore, high-consistency pulp (having most commonly a consistency of 20 to 35%) is diluted to at least a medium consistency (of about 10 to 15%) in the bottom part of the pulp tower. This makes the pulp pumpable with a so-called fluidizing centrifugal pump. Preferably, pulp is diluted to a consistency of about 3 to 5%, whereby it will be pumpable with a conventional centrifugal pump. Dilution is effected by introducing either clean water or filtrate from a suitable process stage into the bottom part of the tower and mixing it with the pulp by agitators arranged for that purpose in the bottom part, i.e. a so-called dilution zone of the tower.

Depending on whether high-consistency pulp towers are used for bleaching or storage, the constructions and appearances of their bottom parts are much different from each other for a number of reasons. Specific to all types of towers is, however, that even dilution is almost unattainable. The reason for this is that high-consistency pulp as well as medium-consistency pulp flows downwards in the tower unevenly. This again is caused by friction between the pulp and the tower wall, which retards the pulp flow so much that between the zone of the diluted pulp in the bottom part and the undiluted pulp in the upper part of the tower there will be formed an arch, which, after having expanded enough, will collapse down to the bottom part of the tower. Since dilution liquid is introduced as an even flow into the tower, the pulp to be discharged from the tower is continuously diluted during arching and, immediately after the arch has collapsed, the consistency will increase to a maximum, whereby the required pulp consistency will remain somewhere between the maximum and the minimum values. In one high-consistency pulp tower the discharge consistency has been established to range from 3.2 to 6.1%. As the pulp is in most cases conveyed from the high-consistency pulp tower to some other process stage, whereby chemicals are mixed with it in pumping or soon thereafter, it is easy to understand that the chemicals dosage per pulp unit cannot be even when the consistency ranges so drastically. Another problem resulting from the collapse of the high-consistency pulp down to the bottom part of the tower may also be difficult, namely it is quite possible that the agitator is damaged by the great volume of pulp falling onto it. In the worst case, the entire process has to be stopped for the repairs of the agitator.

Another way of arranging even downward flow of pulp is described below. In the smallest towers having a diameter of about 3.5 to 7.0 m, the bottom part may be either straight cylindrical or first somewhat narrowing and below that cylindrical. In bigger towers having a diameter typically larger than 5.0 m, a so-called bottom pillar is disposed at the center of the tower bottom. The purpose of the bottom pillar is to uphold pulp above the bottom part and to divide the bottom part into an annular mixing zone. Thus, for example, the maximum diameter of the collapsing pulp arch may only be as long as the tower radius, whereas in the towers with no bottom pillar it may be equal to tower diameter. The shape of the prior art bottom pillars may be either an evenly converging cone, a cylindrical pillar, or a cylindrical pillar the upper end whereof is arranged with an upwardly converging cone. In all those towers, which are provided with a bottom pillar, the dilution agitator/dilution agitators are disposed on the sides of the bottom pillar so that they direct the flow to circulate along the annular mixing zone. The bottom pillars are of solid construction and when disposed on the tower bottom they are merely supported by the tower bottom or the foundation therebelow, in any case by the very point, which would also otherwise carry the weight of the pulp in the tower.

However, it has been shown in practice that neither more conical or cylindrical bottom pillars nor combinations thereof can eliminate the unevenness of the pulp discharge consistency. As already discussed above the discharge consistency may fluctuate from 3.2 to 6.1% when a bottom pillar according to prior art is used. Correspondingly, also the volume flow of the pulp being discharged fluctuates from 210 to 240 $m^3/h$ because the centrifugal pump is not at all insensitive to remarkable changes in the consistency.

At least some of the above-mentioned disadvantages have been overcome with a pulp tower according to U.S. Pat. No. 5,711,600, which discusses an improved high-consistency pulp tower, the bottom part of which has been provided with a bottom pillar of a new shape. The bottom pillar is preferably cylindrical, although other cross-sectional shapes are also applicable. The upper end of the bottom pillar has, however, been reshaped in comparison with prior art constructions. It is essential to the upper end of the pillar that the diameter of a parting member disposed therein is at least in one point larger than the diameter of the lower part of the pillar. In other words, it is a feature of the parting member that in the area of the parting member, the cross-section between the parting member and the wall of the tower is smaller than in the bottom area of the pillar. In accordance with an embodiment of the parting member it is formed of a first section, the diameter of which widens conically upwards, and of a second section, the diameter of which converges conically upwards. In other words, at the contact point between the first and second sections the diameter of the parting member is at its largest, whereby a throttle is formed between parting member and tower wall. The purpose of this throttle is to even the downward flow of the high-consistency pulp.

It has to be noted, however, that the term "conical" has been used above and will be also used further below to specify a piece widening, or correspondingly converging, in some direction. So, in practice, the conical parting member is replaceable with, for example, a quadrangular, a pentangular, or a hexagonal jacket. Correspondingly, the term "diameter" may as well refer to a diameter of an imaginary circle calculated on the basis of the area defined by the above-mentioned polygonal jackets.

However, in experimenting with this new bottom pillar, and its parting member, it has been learned that though the bottom pillar works in a much more reliable manner than the older prior art bottom pillars, the operation thereof can still be improved. For instance, it has been learned that the dilution zone at the bottom part of the tower tends to rise to the level of the parting member or even above it. Also, in some specific cases it has been learned that the dilution arranged by means of, for instance, diluting agitators at the bottom part of the tower is not sufficient, and it should be improved.

The above problems occur especially when the consistency of the fiber suspension in the storage, i.e. the upper, part of the tower is high, and the consistency of the suspension to be discharged from the tower is rather low. This requires that a huge amount of dilution liquid has to be introduced into the pulp. The following example describes a mill-scale case where the pulp storage tower contains fiber suspension in a 30% consistency, and the treatment apparatus after the tower requires 139 l/second of pulp in the consistency of 4%. This means that about 120 l/sec. of dilution liquid has to be provided in the tower. Since normal practice is to add some 30 l/sec. in the outlet pipe where the consistency is adjusted to match exactly the required consistency, the amount of dilution liquid to be added in the dilution, i.e. the bottom, part of the tower is about 90 l/sec. The practice has shown that the diluting agitators of a reasonable size can feed about 20 l/second dilution liquid. Otherwise, the size of the agitators would have to be increased, which is not practical, as it would result in increasing power consumption and increasing height of the dilution part due to increased length of the agitator blades. Thus the only option would be to add the number of agitators to five, which is more than would be needed for proper agitation of pulp.

However, both adding the number of agitators and increasing the agitator size would increase the investment costs and energy consumption. It would also lead to the weakening of the tower structure as either the size or the number of agitator openings in the tower wall would increase. This, in turn, would result in the use of an increased wall thickness of the towers, which leads again to increased investment costs.

SUMMARY OF THE INVENTION

An object of the present invention is to solve at least some of the above-discussed problems found in the high-consistency pulp towers of prior art.

It is also an object of the present invention to make it possible to modernize existing pulp towers, for instance, either to allow the use of higher consistencies in the storage part thereof, or to allow the dilution to a lower consistency, just to name a couple of reasons for the modernization.

Thus the starting point may be a pulp tower having no bottom pillar at all, i.e. a pulp tower of older technology where the thicker pulp has flowed downwards in the dilution zone on its own without any 'braking' means, and without any means which would have directed the flow at the bottom part of the tower caused by at least one agitator mixing dilution liquid with pulp to a circumferential flow. In these cases the bottom part of the tower has, often, been provided with an agitator arranged radially in the tower wall, and the tower wall opposite the agitator has been provided with a plough-like insert for directing the flow the agitator creates to the sides of the tower to build two semi-circular flow patterns in the tower bottom area. When this kind of a pulp tower is modernized the plough-like insert and the agitator are removed. Thereafter the tower bottom is provided with a bottom pillar having a parting member in the top portion thereof, and a required number of agitators—either so-called diluting ones (including dilution liquid feed means) or the ones with the aid of which dilution liquid (separately introduced into the tower) is introduced into the pulp—are added to induce a circulating flow round the bottom pillar, and the area substantially at the level of the smallest cross-section between the tower wall and the parting member is provided with dilution liquid feed means.

It is also possible that the old agitator/agitators, if it/they has/have been properly positioned at the tower bottom part, can be used in the modernization. Therefore, it is not always necessary to bring new agitators to the tower in case of a modernization.

Another main starting point is a pulp tower having already the bottom pillar with the parting member, and the properly positioned agitators. The only thing the modernization requires is the installation of the dilution liquid feed means at the area substantially at the level of the smallest cross-section between the tower wall and the parting member.

A yet further object of the invention is to ensure that the dilution liquid is introduced into the pulp at a distance from the wall of the tower so that the main effect of the dilution liquid is not lubricating the tower wall surface, but to reduce the consistency of the pulp. The object may be achieved in many different ways either by arranging specifically designed baffles or ducts or nozzles at a distance from the tower wall, or between the tower wall and the parting member, or on the surface of the parting member.

Thus the dilution liquid is brought to dilute internally the pulp sliding down along the tower wall. With the word 'internally' is meant the part of pulp which is not sliding along the tower wall. The prior art ways of feeding dilution liquid substantially at the tower wall surface result in the decrease of consistency in the surface layer of the pulp against the wall, whereby larger pulp particles tend to loosen from the pulp pillar and drop in an uncontrolled manner into the dilution part of the tower. Now, by introducing the dilution liquid in one or more radially spaced positions in the pulp pillar at a distance from the tower wall the dilution is more even, as well as the dropping of pulp to the dilution zone.

Thus the present invention suggests that at least a part of the dilution liquid required to dilute the pulp into the tower outlet consistency is introduced between the tower wall and the parting member at the area substantially at the level of the smallest cross-section of the tower. Preferably the dilution liquid is introduced in at least two parts in the dilution part of the tower. One part is introduced to the thick fiber suspension substantially simultaneously as the suspension is taken from the storage part of the tower into the dilution zone, and another part is introduced with the aid of the agitators positioned in the dilution zone.

Other characterizing features of the present invention will be discussed herein.

BRIEF DESCRIPTION OF THE DRAWINGS

An arrangement for and a method of treating pulp, and a method of modernizing a pulp tower according to the present invention, are explained more in detail in the following, by way of example, with reference to the accompanying drawings, in which.

DESCRIPTION OF THE PREFERRED EMBODIMENTS

Figure 1:
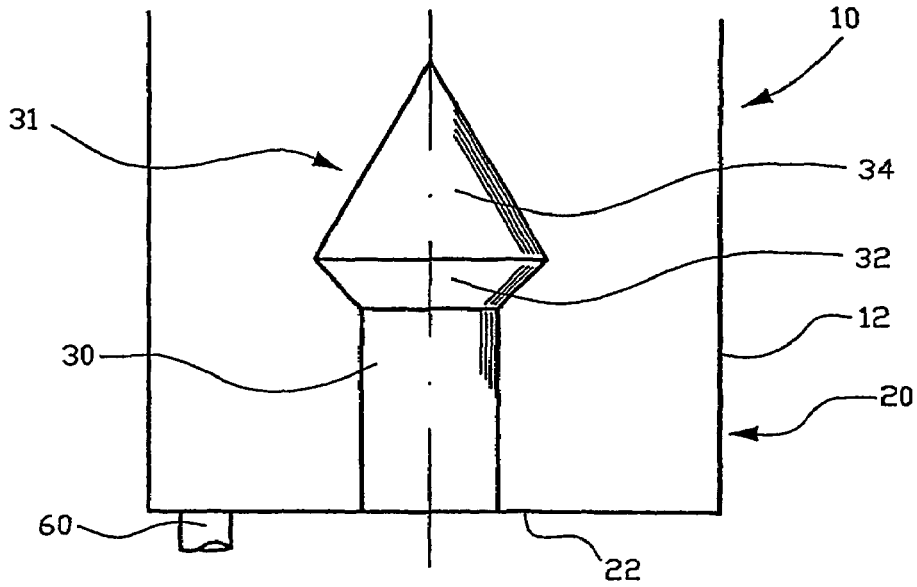
FIG. 1 illustrates the bottom part of a high-consistency pulp tower in accordance with prior art.

FIG. 1 shows an improved prior art high-consistency pulp tower 10 in accordance with U.S. Pat. No. 5,711,600. The bottom part 20 of the tower is provided with a stationary bottom pillar 30, which is preferably cylindrical, although other cross-sectional shapes are also applicable. The upper end of the pillar 30 has, however, been reshaped in comparison with prior art constructions. It is essential to the upper end of the pillar 30 that the diameter of an also stationary parting member 31 disposed therein is at least in one point larger than the diameter of the lower part of the pillar 30. More broadly expressed, at the level of the parting member 31, the cross-sectional area between the parting member 31 and the wall 12 of the tower 10 is smaller than in the bottom area of the pillar 30 below the parting member. In FIG. 1, the parting member 31 is formed of a first section 32, the diameter of which widens conically upwards, and a second section 34, the diameter of which converges conically upwards. In other words, at the point of contact between the first and second sections the diameter of the parting member is at its largest, whereby a throttling is formed between the parting member 31 and the tower wall 12. A purpose of this throttling is to even the downward flow of the high-consistency pulp. Another purpose of the throttling is to separate the bottom part of the tower from the upper part of the tower, as will be explained later on.

It has to be noted, however, that the term "conical" has been used above and will be also used further below to specify a piece widening, or correspondingly converging, in some direction. So, in practice, the conical parting member is replaceable with, for example, a quadrangular, a pentangular, or a hexagonal jacket. Correspondingly, the term "diameter" may as well refer to a diameter of an imaginary circle calculated on the basis of the area defined by the above-mentioned polygonal jackets.

Figure 2:
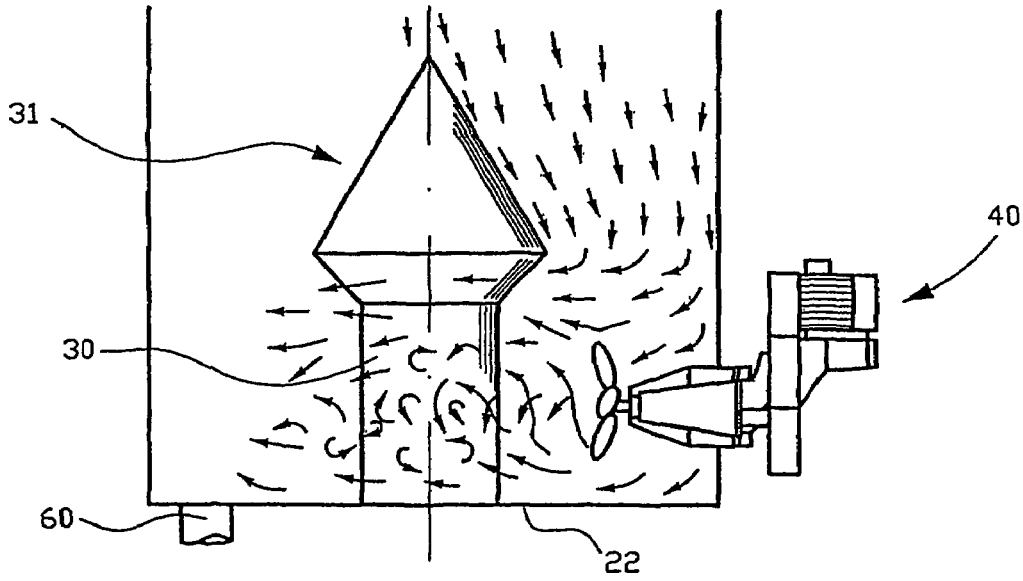
FIG. 2 illustrates in a simplified manner the working of a diluting agitator at the bottom part of a high-consistency pulp tower according to prior art.

FIG. 2 illustrates how the bottom part 20, i.e. a so-called dilution zone, of a high-consistency pulp tower operates in practice. For simplicity reasons, FIG. 2 illustrates only one agitator 40 having its shaft in substantially horizontal direction. The drawing also shows pulp being discharged from only one side of parting member 31 to the mixing or dilution zone of the bottom part of the tower. The shape of parting member 31 serves to exactly mark off the mixing or dilution zone below the largest diameter of the parting member 31 or, more broadly said, below the smallest cross-sectional area between parting member 31 and the wall 12 of the tower 10. Thus, it is the aim of the parting member and its dimensioning that the circulating flow provided by agitators 40 is prevented from rising above the level of the parting member 31. In prior art constructions, the rising of the flow to the upper end of the pillar and even above it caused uncontrolled discharge of pulp from the upper part, the so-called storage part, of the tower to the mixing/dilution zone. Another object of the parting member is that the agitators 40 bring about both a free turbulence and an annular circulation of pulp in the mixing zone of the tower, which free turbulence and annular circulation of pulp, by means of the great difference in both the flow rate and direction, then evenly "cuts" pulp from the slowly downwardly flowing high-consistency pulp to the dilution zone.

Figure 3:
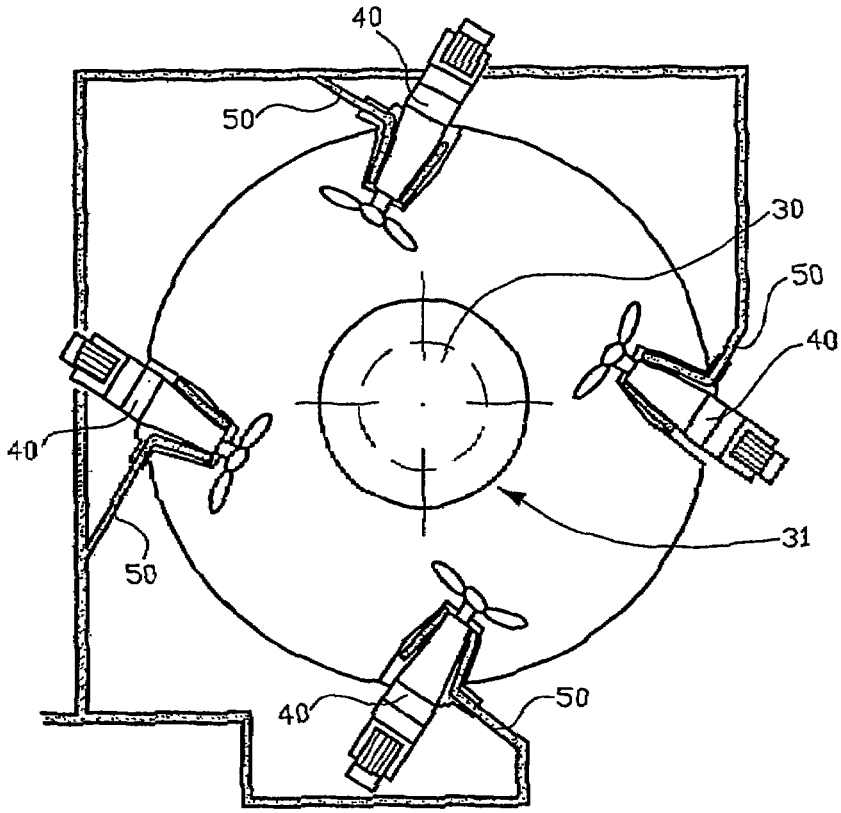
FIG. 3 is a top view of a prior art high-consistency pulp tower having four diluting agitators arranged at the bottom part of the tower.

FIG. 3 shows the bottom part arrangement of the high-consistency pulp tower of FIGS. 1 and 2 seen from above. It can be seen that the bottom part of the tower contains four diluting agitators 40 (the number of agitators may range from two to six, mainly depending on the tower size), each agitator being connected with a feed conduit 50 for dilution liquid. The agitators 40 are disposed in the bottom part 20 of the tower so that they cause the pulp to be diluted to circulate fast around the bottom pillar 30. The agitators, which may be used for feeding dilution liquid to the bottom part of the pulp tower, have been discussed in more detail in FI-B-85164 or FI-B-96043. It is also possible to use ordinary agitators, i.e. agitators having no specific design, for introducing dilution liquid whereby the dilution liquid is preferably introduced into the suction side of the agitator propeller.

Figure 4:
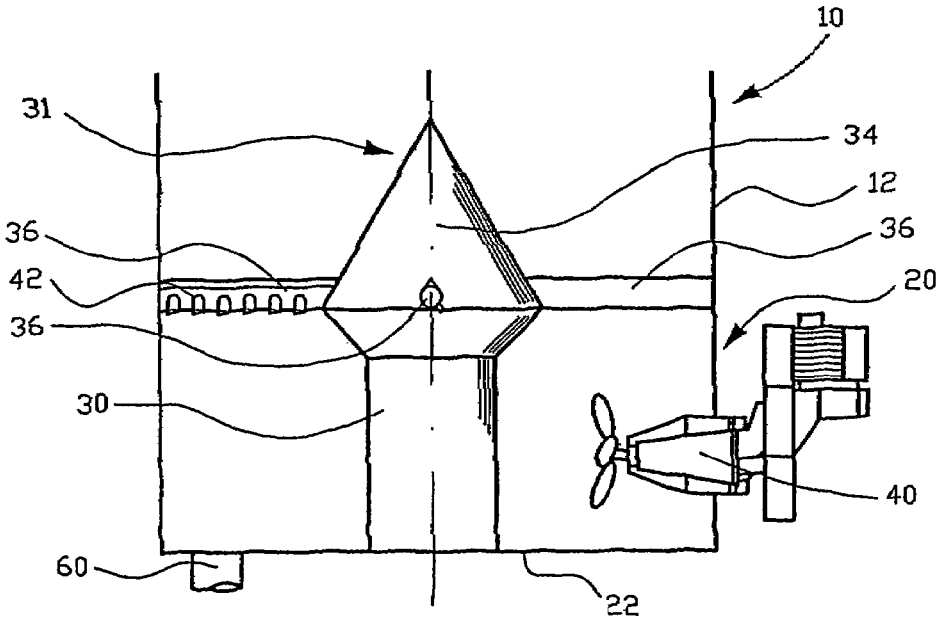
FIG. 4 illustrates the bottom part of a high-consistency pulp tower according to a preferred embodiment of the present invention.

FIG. 4 shows a bottom pillar in accordance with FIG. 1 except that the parting member 31, in accordance with this embodiment the second conical surface 34 thereof, is provided with substantially radial baffles 36, one end of each baffle being attached to the wall 12 of the tower 10. The number of baffles may be two to six and they are intended to prevent the pulp in the tower 10 from starting to rotate to the level of the second conical section 34 of the parting member 31. FIG. 4 also indicates how the agitator 40 is preferably disposed relative to the bottom pillar 30 in the bottom part 20 of the tower. In other words, it is a side-entry agitator the shaft of which is substantially horizontal, and the agitator being arranged in the tower (as shown in FIG. 3) so that it causes the pulp to rotate round the bottom pillar.

All the above features have been discussed in the prior art. However, now the baffles 36 have been provided with means 42 for feeding dilution liquid to the pulp being discharged from the upper part of the pulp tower to the dilution zone in the bottom part 20 of the tower. For doing this either the outside of the tower has been provided with a dilution liquid header (not shown) for introducing dilution liquid to the baffles 36 or the dilution liquid is fed along a piping via the bottom pillar 30 to the baffles 36. Also, it is possible to bring the dilution liquid by some other means to the baffles, for instance by arranging separate pipes within the tower for the dilution liquid. Since the baffles are located in the border area between the storage part of the tower and the dilution part of the tower, the feed of the dilution liquid takes place in the border area. It has been found possible to add dilution liquid up to 50% of the whole dilution liquid volume required by the dilution via the baffles 36. As to the structure of the baffles, it is also possible that the baffles do not extend all the way from the wall to the parting member, but that they are shorter, and fastened only to one of the wall and the parting member.

Figure 5:
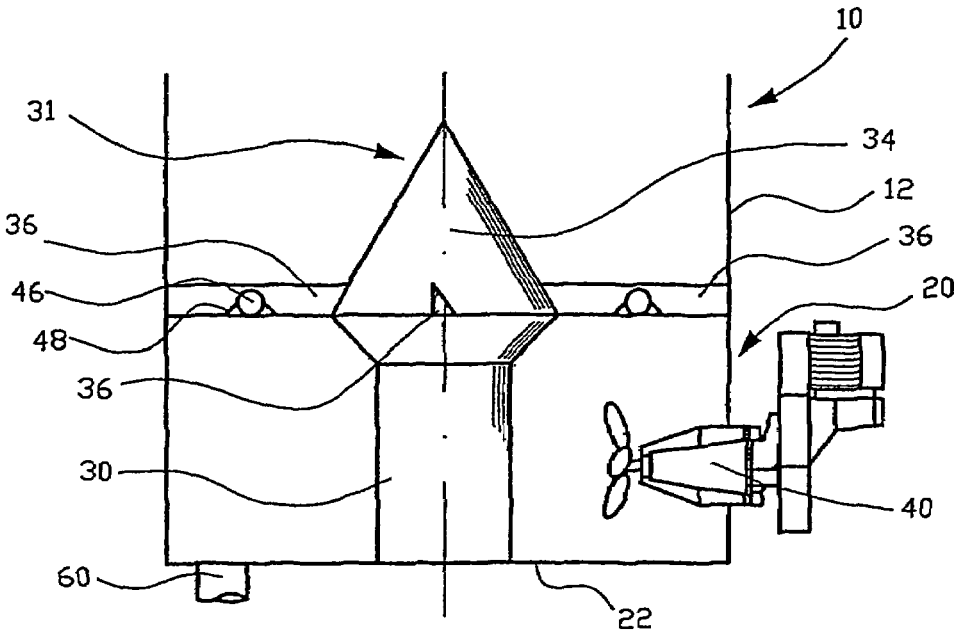
FIG. 5 illustrates the bottom part of a high-consistency pulp tower according to another preferred embodiment of the invention.

FIG. 5 discusses another preferred embodiment of the present invention. In FIG. 5 the baffles 36, or corresponding supporting members, have been provided with an annular duct 46 located between the bottom pillar and the tower wall, the duct 46 being provided with nozzles 48 for introducing dilution liquid into the high-consistency fiber suspension substantially simultaneously with the discharge of the pulp down to the dilution zone. The nozzles 48 are preferably oriented downwards in an inclined manner as shown in the drawings so that they feed the pulp down. Preferably, the nozzles 48 are inclined to the direction of the circulating pulp flow in the dilution zone. The nozzles may also be arranged vertically. However, according to another alternative it is possible to arrange the nozzles inclined upwards, or directly (vertically) upwards so that the nozzles, in a way, lubricate the top surface of the annular duct 46 by feeding dilution liquid against the downwardly flowing pulp. These structural alternatives also apply to the nozzles or openings in the baffles 36 of FIG. 4.

It is also possible to arrange several annular ducts at different radii between the bottom pillar and the tower wall so that the feeding of the dilution liquid takes place in a more controlled and balanced manner. A further advantage is that the dilution liquid is, then, more evenly spread among the pulp. The feed of the dilution liquid to the annular duct/ducts may be arranged via the bottom pillar and the baffles or other supporting members, or via a dilution header from outside the tower and the baffles or other supporting members, or via some other appropriate means.

Figure 6:
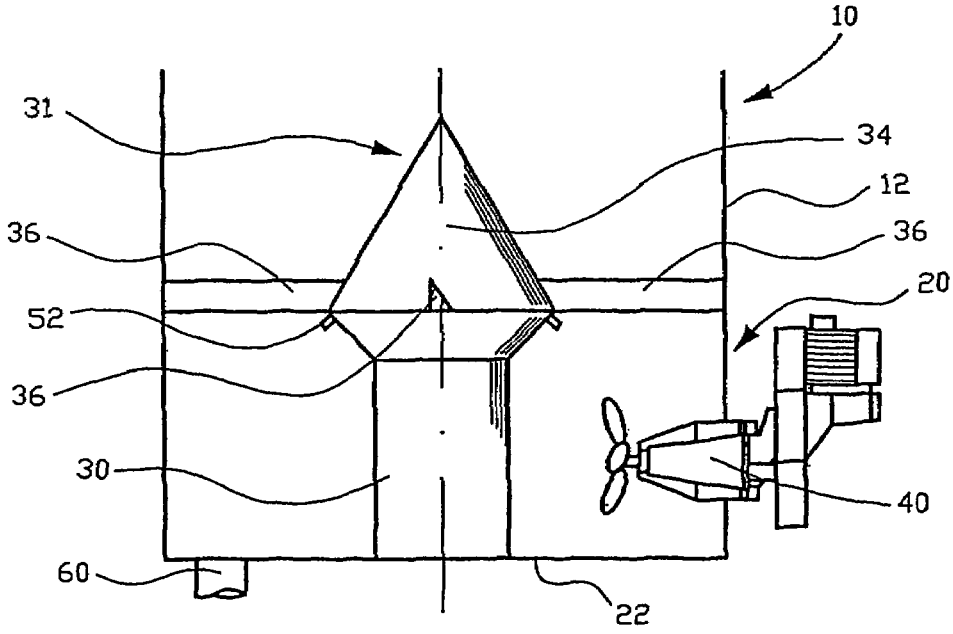
FIG. 6 illustrates the bottom part of a high-consistency pulp tower according to a third preferred embodiment of the invention.

FIG. 6 discloses still another preferred embodiment of the present invention. In FIG. 6 the parting member of the bottom pillar is provided with dilution liquid feed nozzles 52, or mere holes or openings may also be used instead of nozzles. The nozzles 52 have been arranged in the lower conical part of the parting member, though it would also be possible to arrange the nozzles in the upper conical part of the parting member. Also it is possible to provide the upper conical member or, in broader terms, the upper surface of the parting member with openings for the dilution liquid so that the dilution liquid evenly flows onto the surface of the parting member and is absorbed therefrom into the pulp due to the high-consistency difference therebetween.

However, it should be understood that it is an object of the present invention to introduce the dilution liquid in the fiber suspension substantially at the border surface between the storage, i.e. the upper, part of the high-consistency pulp tower, and the dilution, i.e. the bottom, part of the tower. The reason for this is the fact that if the pulp were diluted in the upper storage part, the consistency of the pulp would be lower, the pulp would flow more easily downwards, and the pulp would more easily, and in a much more uncontrolled way, collapse and drop into the dilution zone resulting in remarkable changes in the outlet consistency of the pulp.

Thus, by introducing the dilution liquid substantially at the level of the smallest cross-section between the bottom pillar and the tower wall, a controlled discharge of pulp from the storage part of the tower to the dilution zone is ensured. Also, dimensioning the parting member carefully, and taking into account the dilution substantially at the smallest cross-section and the way it is done, may further improve the discharge of the pulp to the dilution zone from the storage part of the tower.

Figure 7:
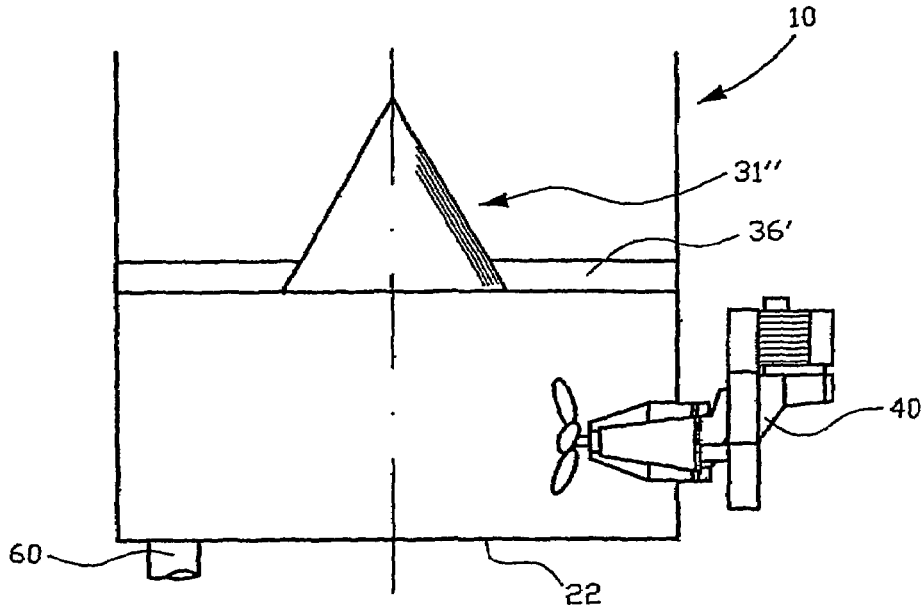
FIG. 7 illustrates the bottom part of a high-consistency pulp tower according to a fourth preferred embodiment of the invention.

FIG. 7 shows an arrangement which slightly deviates from the embodiment described earlier. In this arrangement, a parting member 31" is attached to the tower wall with arms 36', which may be used as baffles 36 of FIG. 4, to prevent the pulp from starting to circulate on the side of the parting member, and for feeding dilution liquid to the pulp flowing down. In a way the biggest difference between this embodiment and the one described above is that there is no lower part of the bottom pillar in this embodiment, but the parting member is totally supported by the arms 36'.

Figure 8:
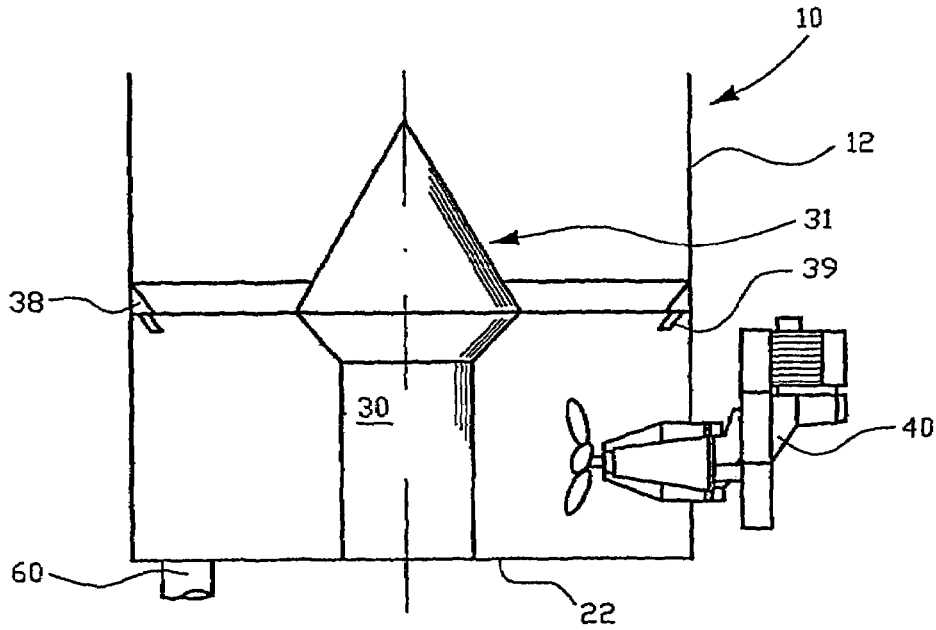
FIG. 8 illustrates the bottom part of a high-consistency pulp tower according to a fifth preferred embodiment of the invention.

FIG. 8 illustrates a bottom pillar 30 according to another embodiment of the present invention and a parting member 31 disposed at the upper end of the pillar. The tip angle of the lower conical section of parting member 31 has been decreased, whereby the length of the first conical section has increased. This drawing shows one more alternative of feeding dilution liquid to the HC pulp flowing down to the dilution zone. In this embodiment the tower wall has been provided with a ring-shaped duct 38 having nozzles 39 for feeding dilution liquid into the pulp. The nozzles 39 may also be arranged through the tower wall without any duct inside the tower.

If we now go back to the example discussed earlier, it is possible to divide the dilution liquid in such a manner that the required 90 l/sec. of dilution liquid may be divided between the diluting agitators and the baffles, the parting member, the ring-shaped ducts and/or the annular ducts so that 60 l/sec is provided by the agitators, i.e. three agitators are needed, and 30 l/sec is introduced to the pulp by the diluting means arranged substantially at the smallest cross-section between the parting member and the tower wall.

As to the various structures of the feed means for the dilution liquid it should be understood that the structures thereof may greatly vary from the one shown in the drawings. For instance, it is possible that only one of the various feed means is used, and it is as well possible that all the above-described feed means are used together. Thus any combination of the above-discussed stationary feed means is feasible and can be used to overcome at least some of the deficiencies of the prior art.

As indicated by the above-described various constructional arrangements, novel, previously unknown constructional arrangements have been developed for the dilution of pulp in a high-consistency pulp tower. These constructional arrangements ensure that the discharge of pulp from high-consistency pulp towers takes place at an even volume flow and steady pulp consistency. One has to remember, however, that the above-described constructional arrangements are only preferred examples of the numerous alternatives embodying the invention. Thus, the above examples are by no means intended to limit the invention from the scope defined in the accompanying claims.

The invention claimed is:

1. An arrangement for treating pulp, said arrangement comprising a high-consistency pulp tower (10) having an upstanding tower wall (12), a bottom (22), and a stationary parting member (31, 31") arranged in the tower, said parting member dividing the tower to an upper part and a bottom part (20), said bottom part defining a so-called dilution zone of said tower (10), at least one agitator (40) arranged in the bottom part (20) for diluting high-consistency pulp, discharge means (60) for diluted pulp arranged in the bottom part (20), and said parting member (31, 31") and said wall (12) of the tower (10) defining a first cross-sectional flow area, which is smaller than a corresponding cross-sectional flow area below the parting member (31, 31"), wherein the arrangement additionally includes means (36, 42; 38, 39; 46; 48) for diluting pulp arranged at a distance from said wall (12) between said parting member (31, 31") and said wall (12) of said tower (10) substantially at the level of said first cross-sectional flow area.

2. The high-consistency pulp tower as recited in claim 1, wherein said diluting means comprises at least one baffle (36, 36') arranged to extend at least partially from one of said parting member (31, 31") and said tower wall (12) towards one of said tower wall (12) and said parting member (31, 31"), respectively.

3. The high-consistency pulp tower as recited in claim 1, wherein said diluting means comprises at least one baffle (36, 36') arranged to extend from said tower wall (12) to said parting member (31, 31").

4. The high-consistency pulp tower as recited in claim 2, wherein said diluting means further comprises openings or nozzles (42) in said baffles (36, 36').

5. The high-consistency pulp tower as recited in claim 1, wherein said diluting means comprises at least one annular duct (46) arranged on supporting members (36) between said parting member (31, 31') and said tower wall (12).

6. The high-consistency pulp tower as recited in claim 1, wherein said diluting means comprises nozzles (48) or openings in said parting member (31) for feeding dilution liquid to the pulp.

7. The high-consistency pulp tower as recited in claim 1, wherein said diluting means (36, 42; 38, 39; 46; 48) is connected to means for introducing dilution liquid in said diluting means (36, 42; 38, 39; 46; 48).

8. The high-consistency pulp tower as recited in claim 7, wherein said dilution liquid introduction means are arranged in connection with one of said wall (12) of said tower (10) and said bottom pillar (30).

9. The high-consistency pulp tower as recited in claim 7, wherein said dilution liquid introduction means is a dilution header arranged outside said tower.

10. The high-consistency pulp tower as recited in claim 7, wherein said dilution liquid introduction means is a piping leading to the parting member (31) via the bottom pillar (30).

11. The high-consistency pulp tower as recited in claim 1, wherein said parting member (31) has been arranged in the top of a so-called bottom pillar (30), which is arranged to the bottom (22) of the tower (10).

12. The high-consistency pulp tower as recited in claim 1, wherein said at least one agitator (40) is arranged to generate a circulating pulp flow in the bottom part (20) of said tower (10).

13. The high-consistency pulp tower as recited in claim 12, wherein said agitator (40) has a shaft positioned substantially horizontally.

14. The high-consistency pulp tower as recited in claim 1, wherein two to six agitators (40) are arranged in the dilution zone of the tower (10).

15. The high-consistency pulp tower as recited in claim 14, wherein said agitators (40) are provided with feed means (50) for introducing dilution liquid into the pulp.

16. The high-consistency pulp tower as recited in claim 1, wherein the parting member (31") is carried by means of baffles (36') on the wall (12) of the tower (10).

* * * * *